US005572980A

United States Patent [19]

Nakagawa et al.

[11] Patent Number: 5,572,980

[45] Date of Patent: Nov. 12, 1996

[54] FUEL SUPPLY CONTROL SYSTEM FOR AN ENGINE

[75] Inventors: Norihisa Nakagawa, Numazu; Hiroki Matsuoka, Susono, both of Japan

[73] Assignee: Toyota Jidosha Kabushiki Kaisha, Japan

[21] Appl. No.: 547,162

[22] Filed: Oct. 24, 1995

[30] Foreign Application Priority Data

Oct. 25, 1994 [JP] Japan ..... 6-260353

[51] Int. Cl.[6] ..... F02D 41/14; F02M 25/08

[52] U.S. Cl. ..... 123/681; 123/698; 123/520

[58] Field of Search ..... 123/679, 681, 123/698, 478, 480, 520, 521

[56] References Cited

U.S. PATENT DOCUMENTS 5,216,997 6/1993 Osanai et al. ..... 123/698

FOREIGN PATENT DOCUMENTS 4-94444 3/1992 Japan .
4-121449 4/1992 Japan .
5-26118 2/1993 Japan .
5-332205 12/1993 Japan .

*Primary Examiner*—Andrew M. Dolinar
*Attorney, Agent, or Firm*—Kenyon & Kenyon

[57] ABSTRACT

A fuel supply control system for an engine comprises a canister for temporarily storing fuel vapor, a purge passage extending between the canister and a intake passage downstream of a throttle valve, and a purge control valve arrange in the purge passage for controlling the amount of a purge gas, that is, air containing fuel vapor, flowing through the purge passage. The purge control valve is controlled by a duty ratio, which is defined as a ratio of a period during which the purge control valve is opened to a duty cycle time. Namely, the purge control valve is driven to make an opening ratio of the purge control valve equal to the duty ratio. The duty cycle for each cycle is calculated before the corresponding cycle starts, in accordance with an engine operating condition at that time. During each cycle, a corrected duty cycle is calculated in accordance with the engine operating condition at that time. Then, the purge control valve is driven to make opening ratio of the purge control valve equal to this corrected duty ratio.

16 Claims, 14 Drawing Sheets

FUEL SUPPLY CONTROL SYSTEM FOR AN ENGINE

BACKGROUND OF THE INVENTION

1. Field of the Invention

The present invention relates to a fuel supply control system for an engine.

2. Description of the Related Art

Japanese Unexamined Patent Publication No. 5-26118 discloses a fuel vapor emission control system for an engine, in which the system includes a canister connected to an intake passage downstream of a throttle valve arranged therein via a purge passage, for temporarily storing fuel vapor, and a duty-controlled purge control valve arranged in the purge passage for controlling an amount of a purge gas, that is, air containing fuel vapor. An opening ratio of the purge control valve is controlled to make the amount of purge gas equal to a target amount determined in accordance with an engine operating condition. In a typical engine having such a system, during the purging operation, the amount of fuel to be injected from a fuel injector to the engine is reduced in accordance with the amount of the purge gas, and more precisely, in accordance with an amount of fuel vapor contained in the purge gas, to thereby make the air-fuel ratio of the engine equal to a target air-fuel ratio. In this engine, if the amount of the purge gas is obtained, the air-fuel ratio is easily maintained at the target air-fuel ratio. Therefore, in the above-mentioned system, the purge control valve is controlled to make the amount of the purge gas equal to a target amount to thereby maintain the air-fuel ratio at the target air-fuel ratio.

In the above-mentioned system, an opening ratio of the purge control valve is controlled by, for example, a duty ratio. The duty ratio is defined as a ratio of a period during which the purge control valve is opened to a duty cycle time. When the opening ratio of the valve is controlled by the duty ratio, if the duty cycle time is set as in a very short period, such as a few millisecond, the opening and closing operation of the valve must be carried out in the very short period. Accordingly, a load on the valve becomes larger. Further, in this condition, the response of the valve deteriorates and thereby a controllability of the amount of the purge gas also deteriorates. To solve this problem, in a typical system, the duty cycle time is set in a relatively long period, such as 100 ms, to thereby decrease the load of the valve. In this connection, the duty ratio for each duty cycle is calculated before the corresponding duty cycle starts, in accordance with the engine operating condition at that time.

When the purging operation is being carried out, if the engine operating condition varies drastically, namely, if, for example, the engine is rapidly accelerated, the target amount of the purge gas also varies drastically. However, as mentioned above, the duty ratio is calculated before the duty cycle starts. Namely, during the duty cycle, the duty ratio is not changed, even if the target amount of the purge gas varies. As a result, if the engine operating condition varies during the cycle, the actual amount of the purge gas deviates from the target amount thereof. Accordingly, a problem occurs that, in an engine in which an amount of fuel to be fed to the engine is controlled in accordance with the amount of the purge gas, if the amount of the purge gas deviates from the target amount thereof, the air-fuel ratio is not be maintained to the target air-fuel ratio. JPP '118 does not teach this problem at all.

SUMMARY OF THE INVENTION

An object of the present invention is to provide a fuel supply control system which is able to maintain an amount of the purge gas at a target amount thereof.

According to the present invention, there is provided a fuel supply control system for an engine having an intake passage and a throttle valve arranged in the intake passage, the system comprising: a canister for temporarily storing fuel vapor, the canister being connected to the intake passage downstream of the throttle valve through a purge passage; a purge control valve arranged in the purge passage for controlling an amount of a purge gas fed into the engine through the purge passage, the purge control valve being cyclically opened and closed, and being adapted to be duty controlled to make an opening ratio of the purge control valve equal to a duty ratio in each duty cycle; first duty ratio calculating means for calculating a duty ratio for every duty cycle of the duty control of the purge control valve, required to make the amount of the purge gas equal to a target amount of the purge gas determined in accordance with the engine operating condition, first duty ratio calculating means calculating the duty ratio before the corresponding duty cycle starts in accordance with an engine operating condition at that time; driving means for driving the purge control valve to make the opening ratio of the purge control valve equal to the duty ratio calculated by the first duty ratio calculating means in each duty cycle; second duty ratio calculating means for calculating a duty ratio for the duty control of the purge control valve, required to make the amount of the purge gas equal to the target amount of the purge gas, second duty ratio calculating means calculating the duty ratio when the corresponding duty cycle is in process in accordance with an engine operating condition at that time; and control means for controlling driving means so that driving means drives the purge control valve to make the opening ratio of the purge control valve equal to the duty ratio calculated by the second duty ratio calculating means during the corresponding duty cycle.

The present invention may be more fully understood from the description of preferred embodiments of the invention set forth below, together with the accompanying drawings.

DESCRIPTION OF THE PREFERRED EMBODIMENTS

Figure 1:
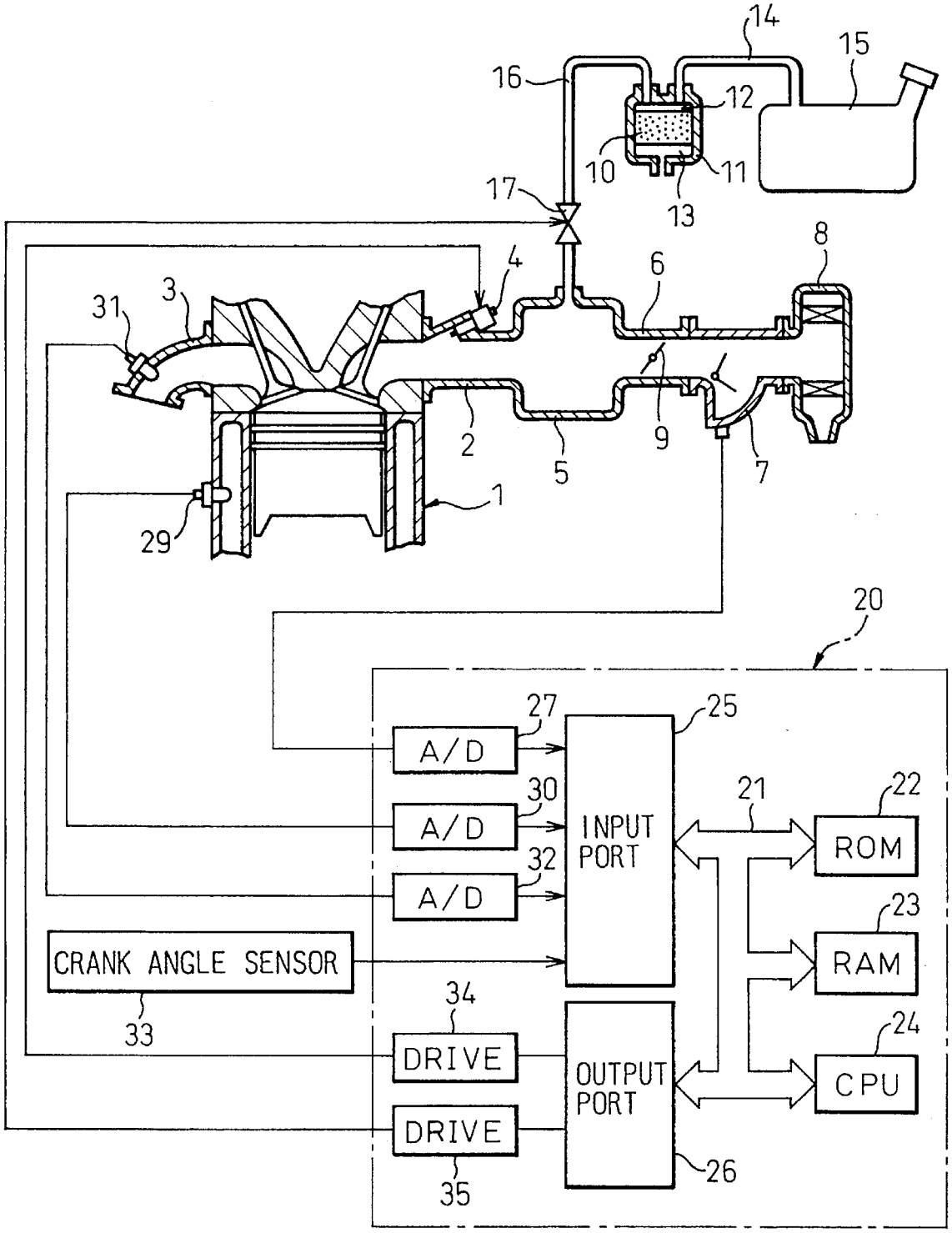
FIG. 1 is a general view of an engine.

Referring to FIG. 1, a reference numeral 1 designates an engine body, 2 designates an intake branch, 3 designates an exhaust manifold, and 4 designates a fuel injector arranged in the respective intake branch 2. Each branch 2 is connected to a common surge tank 5, and the surge tank 5 is connected to an air-cleaner 8, via an intake duct 6 and an air-flow meter 7. A throttle valve 9 is arranged in the intake duct 6. As shown in FIG. 1, the engine comprises a canister 11 in which an activated charcoal layer 10 is housed. The canister 11 has, on one side of the activated charcoal layer 10, a fuel vapor chamber 12 and, on another side of the layer 10, an air chamber 13. The fuel vapor chamber 12 is connected, on one side, to a fuel tank 15 via a conduit 14 and, on another side, to the surge tank 5 via a conduit 16. A purge control valve 17, which is cyclically opened and closed, is arranged in the conduit 16. The purge control valve 17 is controlled by signals output from an electronic control unit 20. Fuel vapor generated in the fuel tank 15 flows into the canister 11 via the conduit 14, and is adsorbed in the activated charcoal layer 10. When the purge control valve 17 is opened, an air flows from the air chamber 13 through the layer 10 into the conduit 16. When the air passes through the layer 10, fuel vapor adsorbed in the layer 10 is desorbed therefrom, and thus, air containing fuel vapor, namely, a purge gas, is fed into the surge tank 5. In this way, a purging operation is carried out.

The electronic control unit 20 is constructed as a digital computer and comprises a read-only memory (ROM) 22, a random-access memory (RAM) 23, a CPU (micro processor) 24, an input port 25, and an output port 26. ROM 22, RAM 23, CPU 24, the input port 25, and the output port 26 are interconnected to each other via a bidirectional bus 21. The air-flow meter generates an output voltage in proportion to an amount of air sucked into the engine, and this output voltage is input to the input port 25 via an AD converter 27. A water temperature sensor 29 generates an output voltage in proportion to a temperature of cooling water of the engine. The output voltage of the sensor 29 is output to the input port 25 via an AD converter 30. A air-fuel ratio sensor 31 is arranged in the exhaust manifold 3. The air-fuel ratio sensor 31 generates an output voltage in proportion to the air-fuel ratio of the engine. The output voltage of the sensor 31 is output to the input port 25 via an AD converter 32. The input port 25 is also connected to a crank angle sensor 33, which generates a pulse whenever a crankshaft is turned by, for example, 30 degrees. According to these pulses, the CPU 24 calculates the engine speed. The output port 26 is connected to the fuel injectors 4 and the purge control valve 17 via respective drive circuits 34 and 35.

In the engine shown in FIG. 1, a fuel injection time TAU is basically calculated using a following equation:

$$TAU=TP\cdot\{1+KK+(FAF-1)+FPG\}$$

where TP: basic fuel injection time
KK: enrichment coefficient
FAF: feedback correction coefficient
FPG: purge correction coefficient The basic fuel injection time TP is a fuel injection time required to make an air-fuel ratio of air-fuel mixture fed into the engine equal to a target air-fuel ratio, and is previously obtained by experiment. This basic fuel injection time TP is stored in advance in the ROM 22 as a function of an engine speed N and an engine load Q/N (an amount of air Q/the engine speed N).

The enrichment coefficient KK is a coefficient for increasing the amount of fuel to be fed into the engine at the time of warm-up of the engine or at the time of acceleration of the engine. This enrichment coefficient KK is made zero when an increase in the amount of fuel is not required.

The purge correction coefficient FPG is a coefficient for correcting the amount of fuel to be fed during the purging operation. The purge correction coefficient FPG is made zero when the purging operation is stopped.

The feedback correction coefficient FAF is a coefficient for correcting the amount of fuel to be fed to make the air-fuel ratio equal to the target air-fuel ratio, based on signals output from the air-fuel ratio sensor 31. While any air-fuel ratio can be used for the target air-fuel ratio, the target air-fuel ratio in this embodiment is a stoichiometric air-fuel ratio. Accordingly, the description hereinafter is related to the case when the target air-fuel ratio is the stoichiometric air-fuel ratio. When the stoichiometric air-fuel ratio is used as the target air-fuel ratio, the air-fuel ratio sensor 31 is constructed by a sensor, the output voltage of which varies in accordance with a concentration of oxygen in the exhaust gas. Therefore, the air-fuel ratio sensor 31 is referred to as an oxygen sensor, hereinafter. The oxygen sensor 31 outputs a voltage of approximately 0.9 volts when the air-fuel ratio is on the rich side of the stoichiometric air-fuel ratio, and of approximately 0.1 volts when the air-fuel ratio is on the lean side of the stoichiometric air-fuel ratio. Next, a control of the feedback correction coefficient FAF based on the output signals of the oxygen sensor 31 will be explained.

Figure 2:
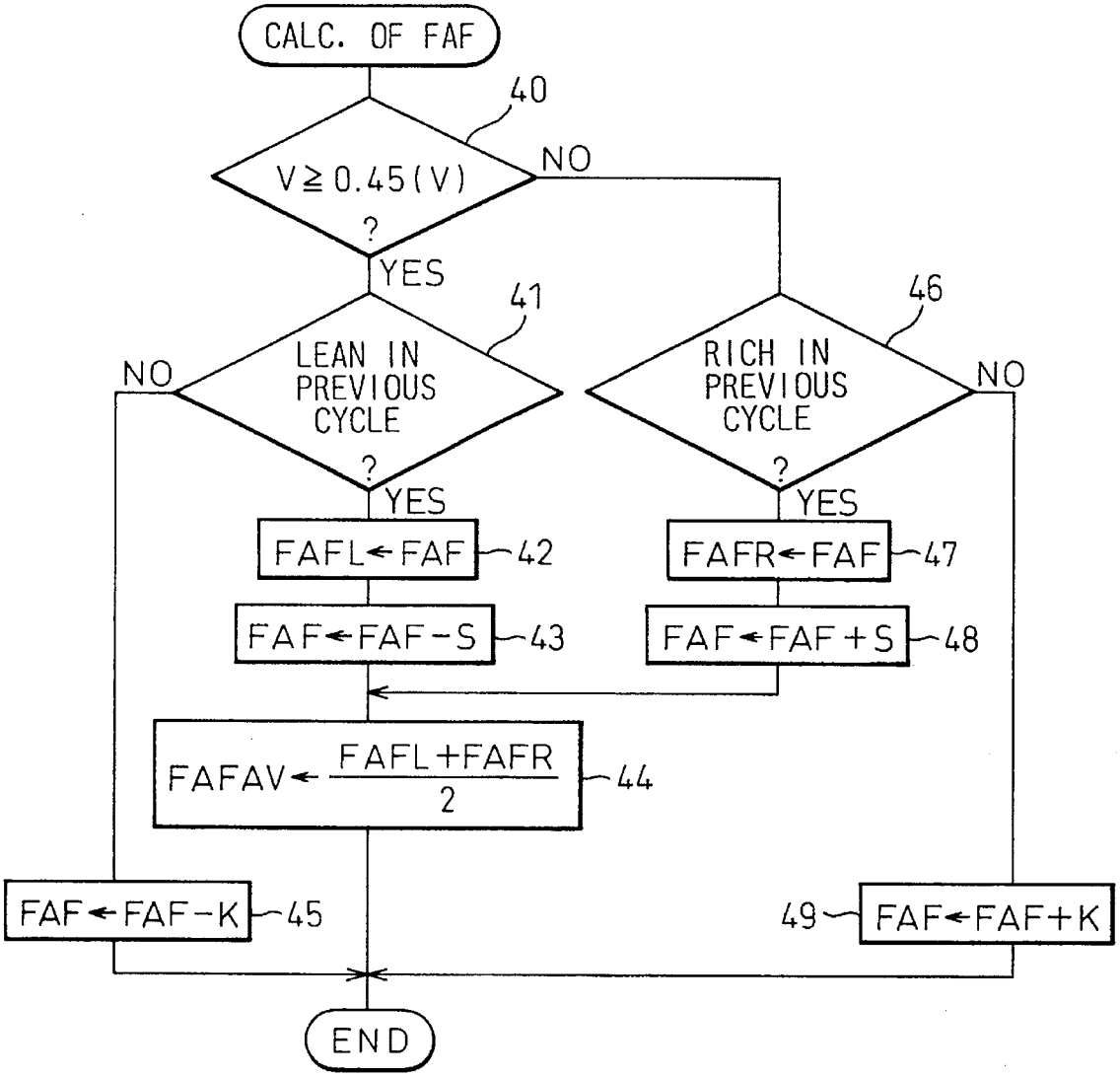
FIG. 2 is a flowchart for calculating a feedback correction coefficient.

FIG. 2 shows a routine for calculating the feedback correction coefficient FAF. This routine is executed in, for example, a main routine for the engine.

Referring to FIG. 2, first, in step 40, it is determined whether the output voltage V of the oxygen sensor 31 is higher than 0.45 Volts, namely, whether the air-fuel ratio is on the rich side of the stoichiometric air-fuel ratio. If $V \geqq 0.45$ V, namely, if the air-fuel ratio is on the rich side of the stoichiometric air-fuel ratio, the routine goes to step 41, where it is determined whether the air-fuel ratio was on the lean side of the stoichiometric air-fuel ratio in the previous processing cycle. If it is determined that the air-fuel ratio was on the lean side in the previous processing cycle, namely, if it is determined that the air-fuel ratio changes from the lean side to the rich side, the routine goes to step 42, where the feedback correction coefficient FAF is memorized as FAFL. In following step 43, the skip value S is subtracted from the feedback correction coefficient FAF, and thereby the feedback correction coefficient FAF is drastically decreased. In following step 44, the average of FAFL and FAFR is memorized as FAFAV. Then, the processing cycle is ended.

Conversely, if it is determined, in step 41, that the air-fuel ratio was on the rich side of the stoichiometric air-fuel ratio in the previous processing cycle, the routine goes to step 45, where the integral value K ($K \ll S$) is subtracted from the feedback correction coefficient FAF. In this case, the feedback correction coefficient FAF is gradually decreased.

If it is determined in step 40 that $V<0.45$ V, namely, if it is determined that the air-fuel ratio is on the lean side of the stoichiometric ratio, the routine goes to step 46, where it is determined whether the air-fuel ratio was on the rich side in the previous processing cycle. If it is determined that the air-fuel ratio was on the rich side in the previous processing cycle, namely if it is determined that the air-fuel ratio changes from the rich side to the lean side, the routine goes to step 47, the feedback correction coefficient FAF is memorized as FAFR. In following step 48, the skip value S is added to the feedback correction coefficient FAF, and thereby, the feedback correction coefficient FAF is drastically increased. In the following step 44, the average of FAFL and FAFR is memorized as FAFAV. Then, the processing cycle is ended. Conversely, if it is determined, in step 46, that the air-fuel ratio was on the lean side of the stoichiometric air-fuel ratio in the previous processing cycle, the routine goes to step 49, where the integral value K is added to the feedback correction coefficient FAF. In this case, the feedback correction coefficient FAF is gradually increased.

When the air-fuel ratio becomes on the rich side and thereby the feedback correction coefficient increases, the fuel injection time TAU is made shorter. When the air-fuel ratio becomes on the lean side and thereby the feedback correction coefficient decreases, the fuel injection time TAU is made longer. As a result, the air-fuel ratio is maintained to the target, stoichiometric air-fuel ratio. In this connection, the feedback correction coefficient FAF alternately increases and decreases relative to 1.0, when the purging operation is stopped. Further, the value FAFAV calculated in step 44 represents the average of the feedback correction coefficient.

If the engine is, for example, accelerated during the purging operation, the amount of air fed into the engine increase, and the amount of the purge gas decreases, since the negative pressure produced in the surge tank 5. This causes, however, the concentration of fuel vapor in air fed into the engine to vary drastically, and thereby the air-fuel ratio varies drastically. To prevent such a variation in the air-fuel ratio during a transient engine operation, this embodiment introduces a reference purge ratio determined in accordance with the engine operating condition, for example, a maximum purge ratio MAXPG, and controls the amount of the purge gas by controlling the opening ratio of the purge control valve 17 in accordance with a ratio of the target purge ratio to the maximum purge ratio. Next, the control of the amount of the purge gas will be explained.

Figure 3A:
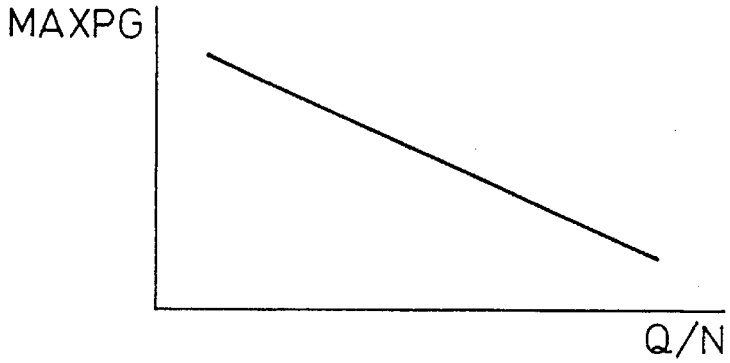
FIGS. 3A through 3C are diagrams illustrating a maximum purge ratio.
Figure 3B:
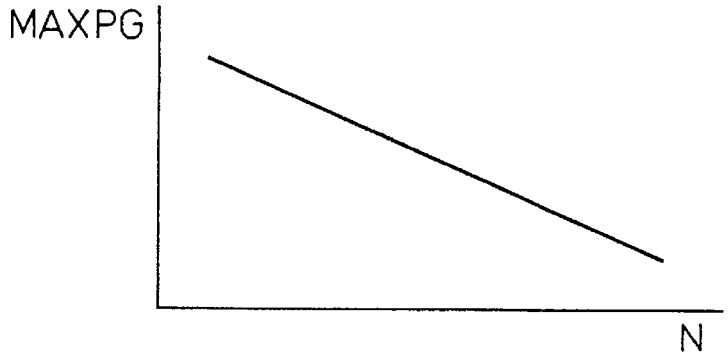
Figure 3C:
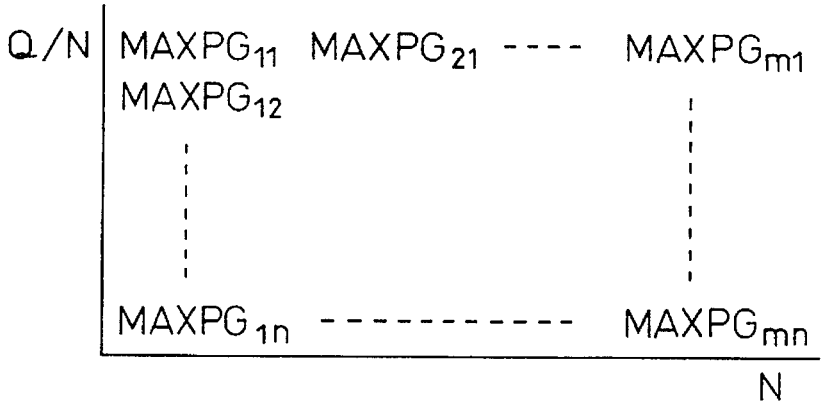

The maximum purge ratio MAXPG is a ratio of the amount of the purge gas when the purge control valve 17 is fully opened, to that of air fed into the engine. As illustrated in FIG. 3A, this maximum purge ratio MAXPG becomes smaller when the engine load Q/N becomes larger, with the constant engine speed N, and becomes smaller when the engine speed N becomes larger, with the constant engine load Q/N, as illustrated in FIG. 3B. The relationship between the maximum purge ratio MAXPG and the engine speed N and the engine load Q/N is stored in advance in the ROM 22 in the form of a map as shown in FIG. 3C. In this embodiment, when the purging operation is to be carried out, the target purge ratio TGTPG is maintained at 5%. Further, the opening ratio of the purge control valve 17 is controlled by controlling a duty ratio, and the duty ratio is controlled in accordance with a ratio of the target purge ratio TGTPG to the maximum purge ratio MAXPG. The duty ratio is defined as a ratio of a period during which the purge control valve is opened to a duty cycle time. In this connection, the maximum purge ratio MAXPG is calculated in accordance with the engine operating condition, and therefore, the duty ratio is also calculated in accordance with the engine operating condition.

Namely, the amount of fuel vapor in the purge gas is not detected, and therefore, the concentration of fuel vapor in air fed into the engine when the purge control valve 17 is fully opened is not detected. On the other hand, the concentration of fuel vapor in air fed into the engine is in proportion to the amount of air fed into the engine, as long as the amount of fuel vapor adsorbed in the activated charcoal layer 10 of the canister 11 is substantially constant. Accordingly, maintaining the concentration of fuel vapor in air fed into the engine constant is accomplished by increasing the opening ratio of the purge control valve 17 to increase the amount of the purge gas when the maximum purge ratio MAXPG becomes smaller. In other wards, when the target purge ratio is set as a constant, controlling the opening ratio of the purge control valve 17 in accordance with a ratio of the target purge ratio TGTPG to the maximum purge ratio MAXPG, namely, making the opening ratio of the purge control valve 17 larger when the maximum purge ratio MAXPG becomes smaller, maintains the concentration of fuel vapor in air fed into the engine to be constant, regardless the engine operating condition. As a result, the air-fuel ratio is maintained constant, even during the engine transient operation. Therefore, the air-fuel ratio is maintained at the stoichiometric air-fuel ratio by the feedback control using the feedback correction coefficient FAF.

When the purging operation starts, the feedback correction coefficient FAF becomes smaller to make the air-fuel ratio equal to the stoichiometric air-fuel ratio, and thus, the average FAFAV becomes gradually smaller. In this condition, the decrement of the feedback correction coefficient FAF becomes larger when the concentration of fuel vapor in air fed into the engine becomes higher, and the decrement of the feedback correction coefficient FAF is in proportion to the concentration of fuel vapor in the air fed into the engine. Therefore, the concentration of fuel vapor in the air fed into the engine can be obtained from the decrement of the feedback correction coefficient FAF. As described above, the concentration of fuel vapor in air fed into the engine is not affected by the engine transient operation, and is in proportion to the target purge ratio TGTPG. Thus, the concentration of fuel vapor in air fed into the engine is in proportion to the product of the target purge ratio and the concentration of fuel vapor per the unit target purge ratio, even when the engine operation is transient. Accordingly, when the feedback correction coefficient FAF decreases, correcting the amount of fuel to be injected in accordance with the concentration of fuel vapor in air fed into the engine, or with the product of the target purge ratio and the concentration of fuel vapor per the unit target purge ratio, maintains the air-fuel ratio to the stoichiometric air-fuel ratio, regardless whether the engine operating condition is in transient.

Next, the correction of the amount of fuel to be injected based on the concentration of fuel vapor will be further explained.

This embodiment introduces a coefficient FGPG corresponding to the concentration of fuel vapor per the unit target purge ratio. The coefficient FGPG is made 1.0 when the concentration of fuel vapor in the air fed into the engine is zero, becomes smaller when the concentration of fuel vapor becomes larger, and is made zero when the concentration of fuel vapor is 100%. Thus, the change of this coefficient (1-FGPG) represents the concentration of fuel vapor in air fed into the engine per the unit target purge ratio. The purge correction coefficient FPG mentioned above is represented as the product of the change of the fuel vapor concentration coefficient and the purge ratio ((1-FGPG)·PRG). Therefore, when the concentration of fuel vapor increases and thereby the coefficient FGPG decreases, the amount of fuel to be injected is decreased, as can be understood from the above-mentioned equation for calculating the fuel injection time TAU.

Next, the calculation of the fuel vapor concentration coefficient FGPG will be explained. In this embodiment, the fuel vapor concentration coefficient FGPG is renewed, every predetermined cycle, using the following equation:

$$FGPG=FGPG+KFGPG$$

where KFGPG is a renewing value of the coefficient FGPG. The renewing value KFGPG is calculated as follows: the renewing value KFGPG is made zero when the average of feedback correction coefficient FAFAV is within a predetermined range, that is, when $1-Z \leqq FAFAV \leqq 1+Z$, where Z is a small constant. Contrarily, when the average FAFAV is out of the range, that is, when $FAFAV<1-Z$ or $1+Z<FAFAV$, the renewing value KFGPG is calculated using the following equation:

$$KFGPG=(1-FAFAV)/PRG$$

where PRG is a purge ratio corresponding to the target purge ratio TGTPG. This purge ratio PRG is basically equal to the target purge ratio TGTPG, as explained below. Therefore, the fuel vapor concentration coefficient FGPG is not renewed when $1-Z \leqq FAFAV \leqq 1+Z$, and is renewed by the deviation of the average of feedback correction coefficient 1-FAFAV per the purge ratio PRG when $FAFAV<1-Z$ or $1+Z$ FAFAV.

When the purging operation starts, the feedback correction coefficient FAF decreases. On the other hand, when the feedback correction coefficient FAF decreases, the fuel vapor concentration coefficient FGPG decreases and the purge correction coefficient FPG decreases, and thereby the amount of fuel to be injected is reduced. This results in the reduction of the amount of fuel to be injected without largely deviating the feedback correction coefficient FAF from a reference value thereof.

As mentioned above, the decrement of the feedback correction coefficient FAF during the purging operation is in proportion to the concentration of fuel vapor in air fed into the engine. The change of the fuel vapor concentration coefficient (1-FGPG) increases by a value which the feedback correction coefficient FAF should decrease, and thus, the sum of the purge correction coefficient FPG represented by the product of (1-FGPG) and PRG, and the decrement of feedback correction coefficient (1-FAF) represents the concentration of fuel vapor in air fed into the engine. Accordingly, as mentioned above with reference to the equation for calculating the fuel injection time TAU, correcting the basic fuel injection time TP using the sum of the decrement of the feedback correction coefficient (1-FAF) and the purge correction coefficient FPG maintains the air-fuel ratio to the stoichiometric air-fuel ratio. In this connection, when the feedback correction coefficient becomes 1.0, FPG correctly represents the concentration of fuel vapor in air fed into the engine.

As long as the purge ratio PRG is made equal to the target purge ratio TGTPG, the air-fuel ratio is prevented from deviating from the stoichiometric air-fuel ratio, even when the engine is accelerated and thereby the amount of air fed into the engine increases, since the duty ratio is basically increased while the purge ratio PRG is kept constant. However, if the engine is accelerated while the duty ratio D is almost 100% just before the engine is accelerated, the duty ratio D is limited to 100%, namely the duty ratio D does not increase over 100%. However, in this case, the purge ratio PRG becomes smaller even though the target purge ratio TGTPG is kept constant, and thereby the purge correction coefficient FPG increases. In this condition, the concentration of fuel vapor in air fed into the engine is lowered, but the purge correction coefficient FPG increases by the amount corresponding to the decrement of the concentration of fuel vapor. Accordingly, the air-fuel ratio is maintained at the stoichiometric air-fuel ratio. In this connection, the purge ratio PRG is made equal to the target purge ratio TGTPG as long as the duty ratio D is no larger than 100%.

Next, the duty-control of the purge control valve 17 will be explained, with reference to FIGS. 4A, 4*b*, 5, and 6.

Figure 4A:
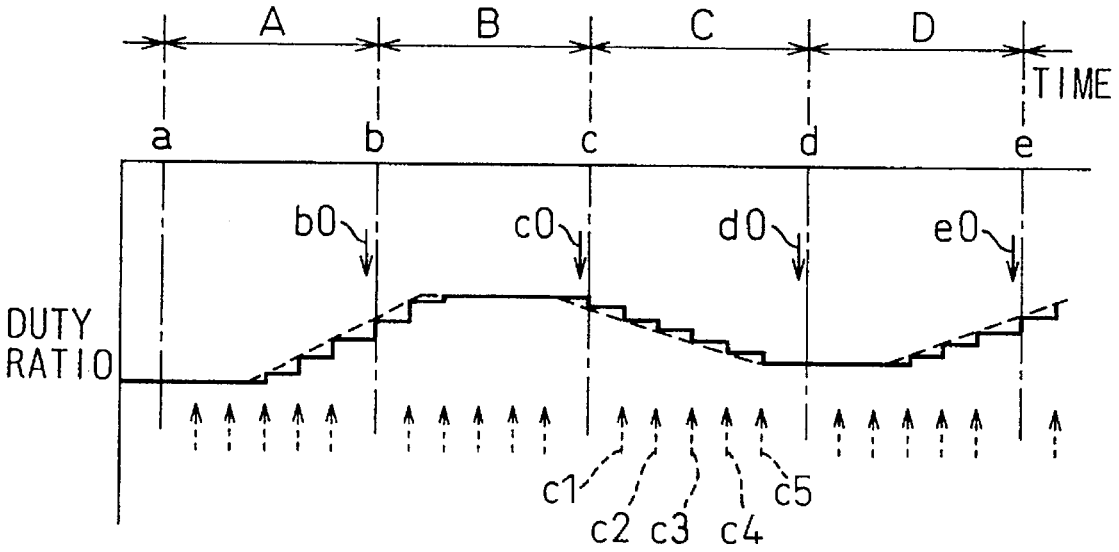
FIG. 4A is a timechart for illustrating a variation of a duty ratio, according to an embodiment of the present invention.

FIG. 4A is a timechart illustrating a change of the duty ratio D according to this embodiment. In FIG. 4A, the characters A, B, C, and D represent duty cycles which start from the time a, b, c, and d, respectively. In each duty cycle, as shown in an example (i) of FIG. 5, the duty cycle starts at the time f, and at the same time, the purge control valve 17 is opened. The purge control valve 17 is closed after the time corresponding to the duty ratio DI has passed, and this duty cycle is ended when the time becomes g. Basically, the opening operation and the closing operation of the purge control valve 17 are made once, respectively, in each duty cycle. The duty cycle time tC, namely, for example, g-f, is set as 100 ms, constant. Therefore, the duty cycle is provided every 100 ms, during the purging operation. By setting the duty cycle time as 100 ms, the load of the purge control valve 17 is reduced.

The duty ratio, for example, Dc for the duty cycle C, which starts from the time c, is calculated before the corresponding duty cycle C starts, as a matter of course. In this embodiment, the duty ratio Dc is calculated at the time c0, namely 4 ms before the duty cycle C starts, on the basis of the engine operating condition at that time. When the time becomes c, the duty cycle C starts and is controlled by the duty ratio Dc.

Figure 4B:
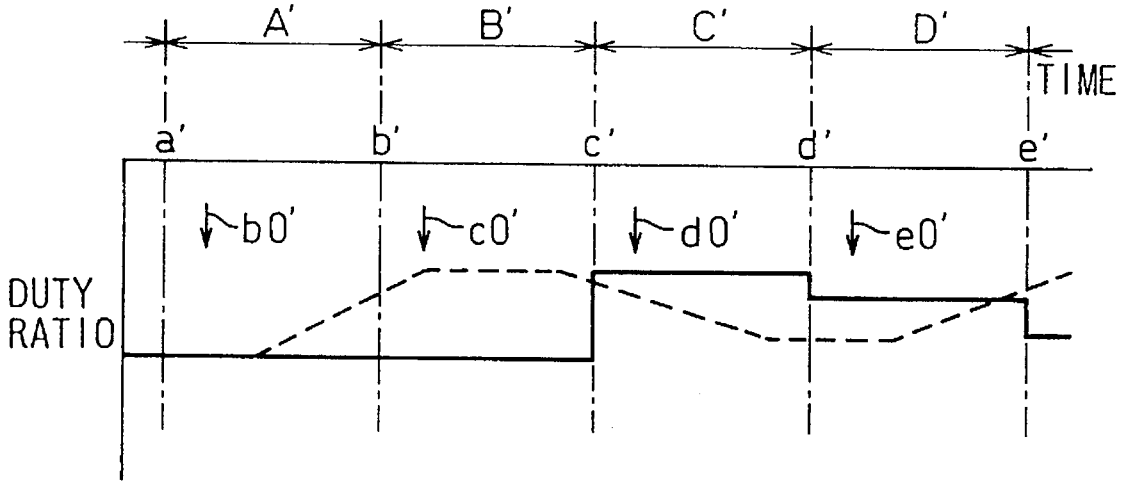
FIG. 4B is a time chart for illustrating a variation of a duty ratio, according to an undesired example.

Contrarily, referring to FIG. 4B which illustrates the undesired example, the duty ratio Dc' for the duty cycle C', which starts from the time C', is calculated at the time c0', on the basis of the engine operating condition at that time. In the typical engine in which the purging operation is carried out, the duty ratio of the duty-control for the purge control valve 17 is calculated in the main routine. In such an engine, the duty ratio Dc' is calculated when the routine goes to the part for calculating the duty ratio at the first time after the previous cycle B' starts, namely after the time b', on the basis of the engine operating condition at that time. Therefore, in the example shown in FIG. 4B, the time in which the duty ratio, for example, is calculated, for example, c0', is not constant relative to the time in which the corresponding duty cycle starts, for example, c', and is approximately 20 ms from the time in which the previous duty cycle starts, for example, b'.

If the engine operating condition varies and thereby the maximum purge ratio MAXPG varies, the duty ratio required to make the actual purge ratio equal to the target purge ratio TGTPG varies in accordance with the time, as illustrated with dotted lines in FIGS. 4A and 4B. In FIG. 4B, illustrating the undesired example, the duty ratio, for example, Dc' for the duty cycle C' is calculated on the basis of the engine operating condition of the time of approximately 80 ms before the duty cycle C' starts. As a result, in the duty cycle C', the duty ratio Dc' varies from a duty ratio required to make the actual duty ratio equal to the target duty ratio. The duty ratio is illustrated by the solid line in FIG. 4B. Therefore, the delay will occur in the response of the duty control.

Such a delay may be reduced by shortening the duty cycle time of the duty control. However, if the duty cycle time is shortened to, for example, a few milliseconds, the opening and closing operations must be done within the very short period, and thereby the load of the purge control valve 17 becomes larger. This embodiment calculates the duty ratio just before the corresponding duty cycle starts, namely, at the time of 4 ms before the corresponding duty cycle starts on the basis of the engine operating condition at that time, while setting the duty cycle time as 100 ms. Accordingly, the response delay of the duty control is reduced, while the load on the purge control valve 17 is reduced. In this connection, the duty ratio calculated before the corresponding duty cycle starts is referred as a renewed duty ratio, hereinafter. The duty ratio renewing operation is carried out once for each duty cycle.

In the typical duty control as in the example shown in FIG. 4B, the duty ratio is kept constant at the renewed duty ratio, during the corresponding duty cycle. On the other hand, when the engine operating condition varies during the duty cycle, the duty ratio required to make the actual purge ratio equal to the target purge ratio varies. However, if the engine operating condition varies when the duty ratio is kept constant during each duty cycle, the actual duty ratio deviates from the target purge ratio, nevertheless the duty ratio renewing operation is carried out just before the corresponding duty cycle starts. On the other hand, during the purging operation, the amount of fuel to be injected is reduced on the basis of the purge ratio PRG corresponding to the target purge ratio TGTPG. Therefore, if the actual purge ratio deviates from the target purge ratio, the air-fuel ratio is no longer maintained at the stoichiometric air-fuel ratio.

To solve this problem, this embodiment calculates a duty ratio during the corresponding duty cycle on the basis of the engine operating condition at that time, and controls the opening ratio of the purge control valve 17 in accordance with this duty ratio to make the actual purge ratio equal to the target purge ratio. Hereinafter, the duty ratio calculated during the corresponding duty cycle is referred as a corrected duty ratio. As a result, even if the engine operating condition varies during the duty cycle, the deviation between the actual duty ratio and the duty ratio required to make the actual purge ratio equal to the target purge ratio is reduced. Namely, controlling the opening ratio of the purge control valve 17 in accordance with the corrected duty ratio reduces the deviation of the actual purge ratio from the target purge ratio. Accordingly, by reducing the amount of fuel to be injected in accordance with the corrected purge ratio, the air-fuel ratio is still maintained at the target, stoichiometric, air-fuel ratio.

In the example illustrated in FIG. 4A, for example, during the duty cycle C, the duty ratio for the duty cycle C is corrected at the time C1, C2, C3, C4, and C5, as shown by dotted arrows in FIG. 4A. Namely, the corrected duty ratio is calculated every 16 ms after the duty cycle C starts, on the basis of the engine operating condition at the corresponding time, and is substituted for the current duty ratio, in turn. As a result, the deviation of the actual duty ratio from the duty ratio required to make the actual purge ratio equal to the target purge ratio is further reduced. The duty ratio used for the control of the purge control valve 17 is illustrated by the solid line in FIG. 4A. Therefore, the actual air-fuel ratio is kept more accurately at the stoichiometric air-fuel ratio. Next, the correction of the control of the purge control valve when the duty ratio is corrected will be explained with reference to FIGS. 5 and 6.

Figure 5:
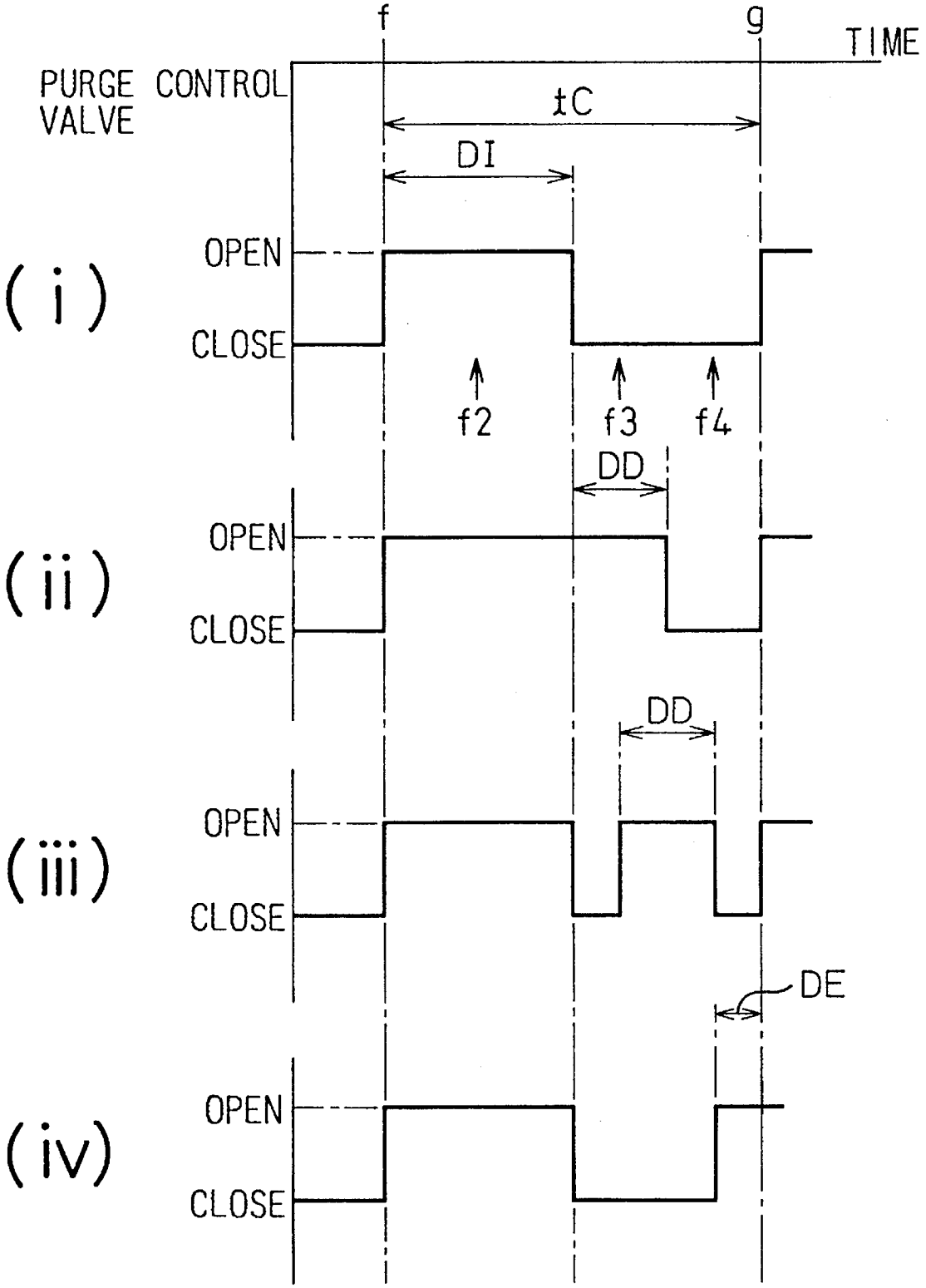
FIGS. 5 and 6 are timecharts for illustrating a duty ratio correcting operation.
Figure 6:
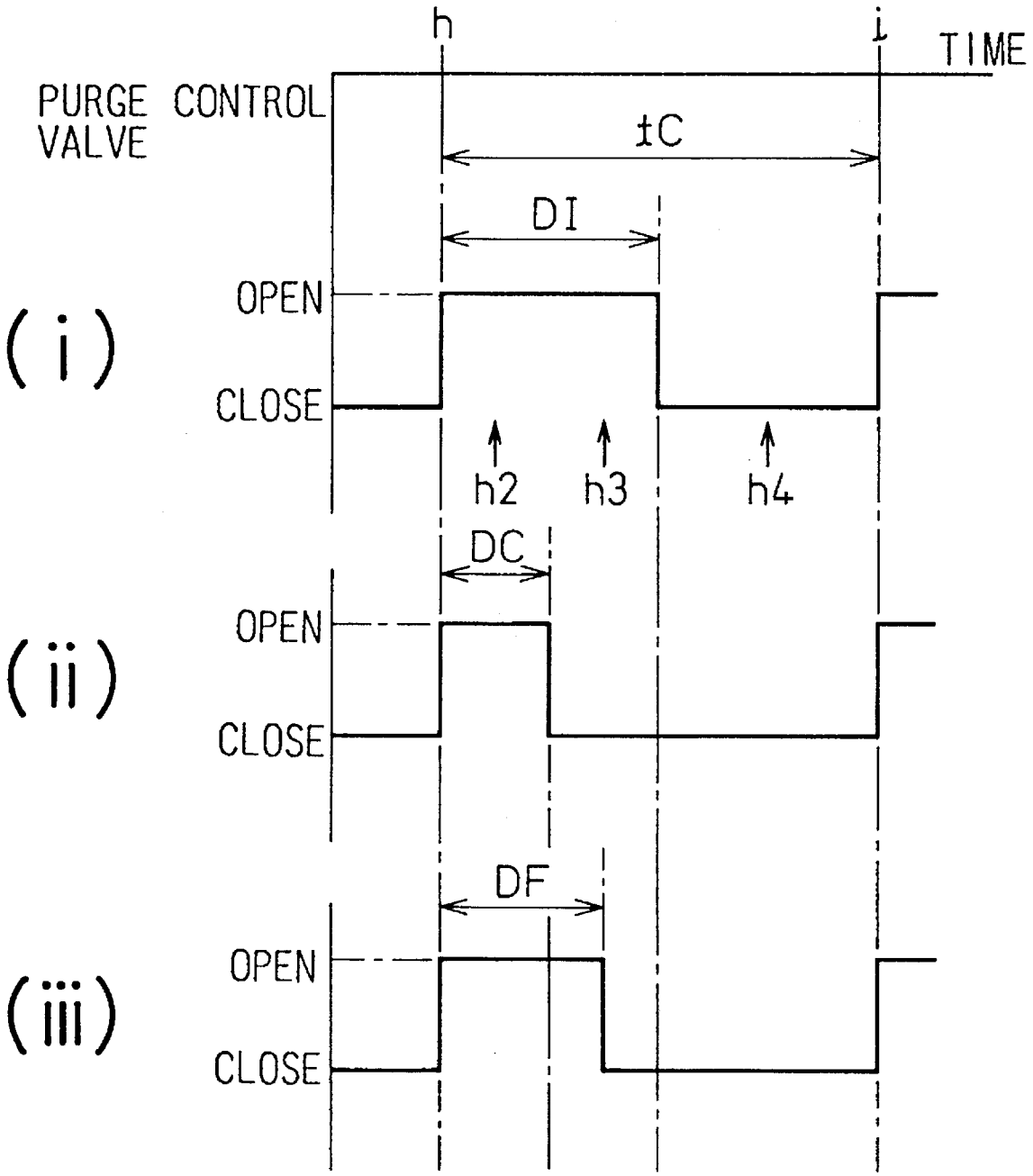

In the example shown in (i) of FIG. 5 or the example (i) of FIG. 6, the duty ratio for the duty cycle, which starts from the time f or h, is made DI, namely, the renewed duty ratio is made DI. In this embodiment, the duty cycle time tC is predetermined as 100 ms. Therefore, when the duty ratio is expressed by the percentage, the opening ratio of the purge control valve 17 is made equal to the duty ratio by opening the purge control valve 17 for the time of the product of the duty ratio and 1 ms from the corresponding duty cycle starts. Accordingly, in the example (i) of FIG. 5, the closing time of the purge control valve 17 is the time of f+DI. This closing time is set in a timer, on which the CPU 24 acts, and when the time becomes the closing time, the purge control valve 17 is closed.

First, referring to examples (ii) to (iv) of FIG. 5, cases wherein the corrected duty ratio DC is larger than the current duty ratio DD, namely the time during which the purge control valve 17 is to be opened is lengthen by DD, will be explained. The example (ii) of FIG. 5 illustrates a case in which the duty ratio correcting operation is carried out at the time f2. At the time f2, the purge control valve 17 is still opened. In this case, the closing time is changed from f+DI to f+DC, namely, f+DI+DD. This corrected closing time is set in the timer, and thereby, when the time becomes f+DI+DD, the purge control valve 17 is closed. Accordingly, the opening period of the purge control valve 17 is made equal to the corrected duty ratio in this duty cycle.

The example (iii) of FIG. 5 illustrates a case in which the duty ratio correcting operation is carried out at the time f3. At the time f3, the purge control valve 17 is already closed, and thus, the purge control valve 17 is opened at the time f3, again. The closing time is made f3+DD, and is set in the timer. Accordingly, the opening period of the purge control valve 17 is made equal to the corrected duty ratio in this duty cycle.

When the duty ratio correcting operation is carried out at the time f4, the purge control valve 17 is opened at the time f4, and the closing time is set as f4+DD. However, if the time f4 is at the end of the duty cycle, or if the increment DD is relatively large, the closing time f4+DD is after f+tC, namely the end time of the duty cycle g. Therefore, in this example (iv), if f4+DD≧f+tC, the closing time is made f+tC, namely g. Accordingly, in the example (iv), the corrected duty ratio is changed to DI+DE, namely DI+(g−f4).

Next, examples in which the corrected duty ratio DC is smaller than the current duty ratio DI will be explained, referring to examples (ii) and (iii) of FIG. 6. In the example (ii) of FIG. 6, the duty ratio correcting operation is carried out at the time h2. At the time h2, the purge control valve 17 is still opened, and the time h2 is before the time h+DC, which is a closing time in accordance with the corrected duty ratio DC. In this case, the closing time is changed to h+DC and is set in the timer. Accordingly, the purge control valve 17 is closed at the time h+DC. Therefore, the opening period of the purge control valve 17 is made equal to the corrected duty ratio in this duty cycle.

In the example (iii) of FIG. 6, the duty ratio correcting operation is carried out at the time h3. At the time h3, the purge control valve 17 is still opened, but is after the time h+DC, which is a closing time in accordance with the corrected duty ratio DC. In this case, the closing time is changed h3, and is set in the timer. Therefore, the purge control valve 17 is closed immediately at the time h3, and thus the corrected duty ratio is DF, namely, h3−h.

If the duty ratio correcting operation is carried out at the time h4, the purge control valve 17 is already closed at the time h4. Therefore, the duty ratio is no longer reduced, in this case.

Next, the control of the purging operation will be further explained with reference to FIGS. 7 to 12.

Figure 7:
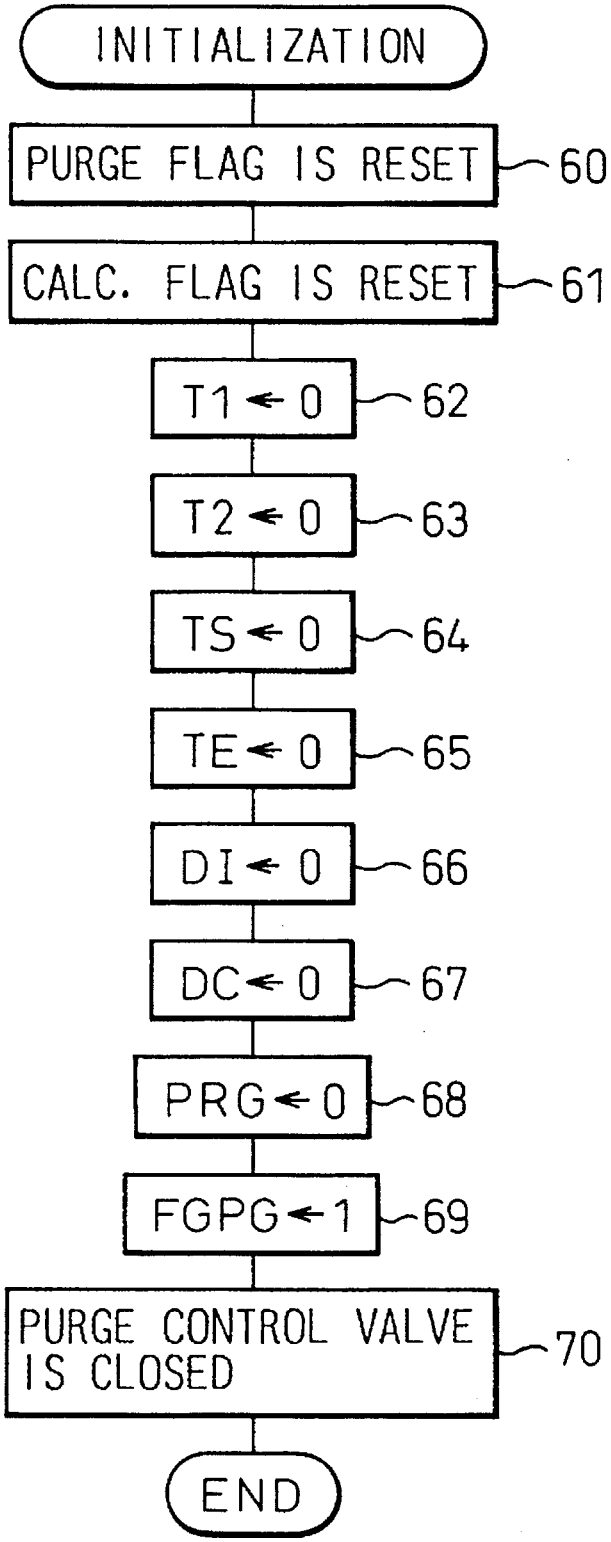
FIG. 7 is a flowchart for executing an initialization.

FIG. 7 illustrates a routine for executing an initialization. This routine is carried out once when an ignition switch (not shown) of the engine is turned ON.

Referring to FIG. 7, first, in step 60, a purge flag, which is set when the purging operation is to be carried out, is reset. In following step 61, a calculation flag, which is set when the renewing or correcting operation of the duty ratio is carried out, is reset. In following steps 62 and 63, a first counter value T1 and a second counter value T2 are both cleared. In following steps 64 and 65, the opening time TS and the closing time TE of the purge control valve 17 are both cleared. In following steps 66 and 67, the duty ratio DI and the corrected duty ratio DC for the purge control valve 17 are both made zero. In following step 68, the purge ratio PRG is made zero. In following step 69, the fuel vapor concentration coefficient FGPG is made 1. In following step 70, the purge control valve 17 is closed. Then the processing cycle is ended.

FIGS. 8 to 11 illustrate a routine for controlling the purging operation. This routine is executed by interruption every predetermined time, such as 4 ms.

Figure 8:
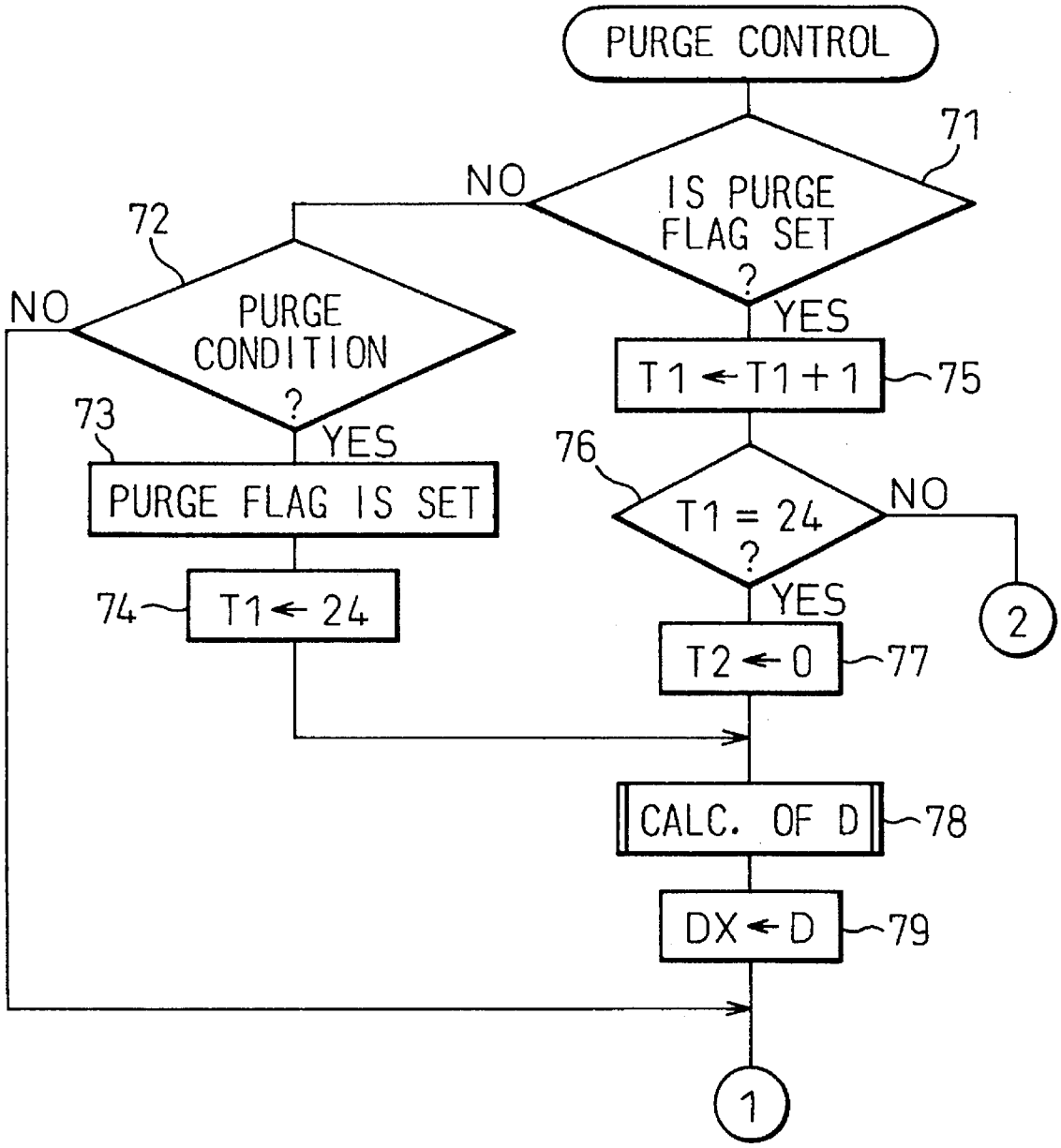
FIGS. 8 through 11 are a flowchart for controlling the purging operation.
Figure 9:
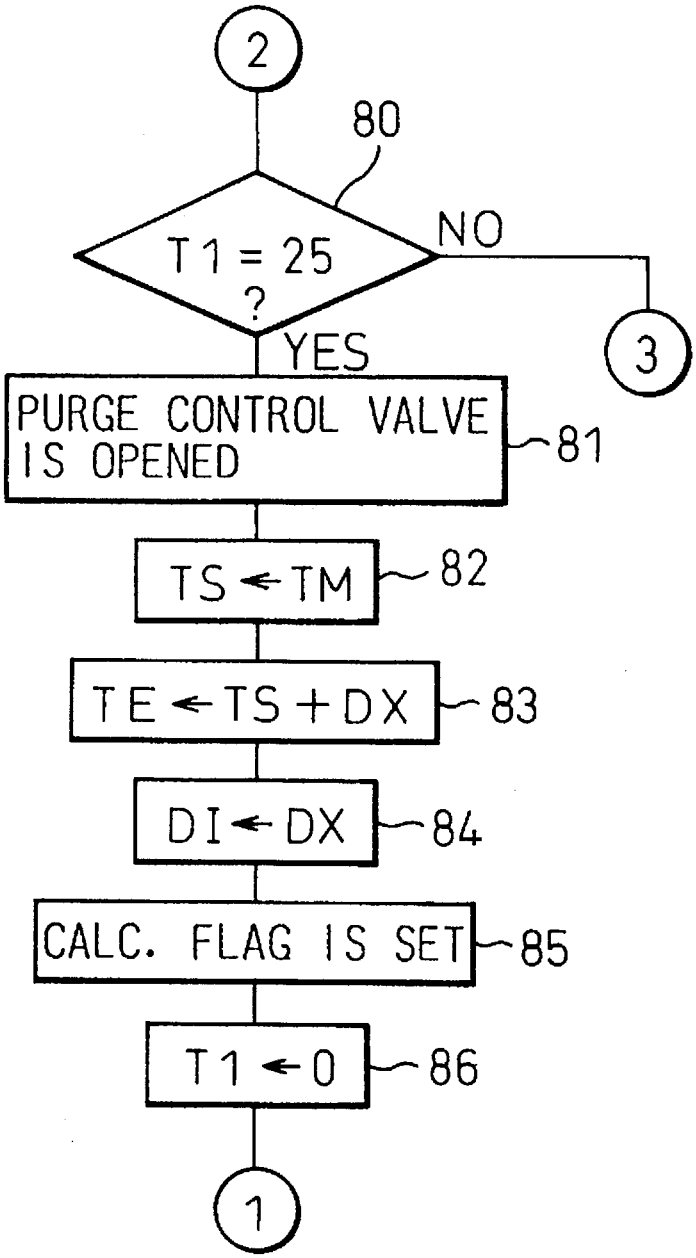

Referring to FIG. 8, first, in step 71, it is determined whether the purge flag is set. If it is a first time for the routine to go to step 71 after the ignition switch is turned ON, the purge flag is reset, and thus the routine goes to step 72. In step 72, it is determined whether a condition in which the purging operation can be carried out is established. In this embodiment, it is determined that the purge condition is established when the temperature of the engine cooling water is above 70° C., the feedback control of the air-fuel ratio is started, and the skipping operation of the feedback correction coefficient FAF (S shown in FIG. 2) is carried out more than five times. If it is determined that the purge condition is not established, the processing cycle is ended. Contrarily, if it is determined that the purge condition is established, the routine goes to step 73, where the purge flag is set. In following step 74, the first counter value T1 is made 4, and the routine jumps to step 78.

In step 78, the duty ratio D is calculated using the routine shown in FIG. 12, explained below, on the basis of the current engine operating condition. This duty ratio corresponds to the renewed duty ratio. In the following step 79, the duty ratio D is memorized as DX. Then, the processing cycle is ended.

In the following processing cycle, since the purge flag is set, the routine goes from step 71 to step 75, where the first counter value T1 is incremented by 1. In following step 76, it is determined whether the first counter value T1 equals 24. If it is a first time for the routine to go to step 76 after the purge flag is set, the first counter value T1 equals 25, and thus the routine goes to step 80 shown in FIG. 9. In step 80, it is determined whether the first counter value T1 equals to 25. If it is a first time for the routine to go to step 80 after the routine goes to step 74, the first counter value T1 equals to 25, and thus the routine goes to step 81. In step 81, the purge control valve 17 is opened. Accordingly, the current time is the starting time of the duty cycle. In following step 82, the current time TM is memorized as the opening time TS of the purge control valve 17. In following step 83, the closing time TE of the purge control valve 17 is set as TS+DX, where DX is obtained in step 79. This closing time TE is set in the timer, and when the time becomes the closing time TE, the purge control valve 17 is closed. In this embodiment, the duty cycle time is set as 100 ms, as mentioned above. Therefore, when the duty ratio is obtained as a percentage, the opening ratio of the purge control valve 17 is made equal to the duty ratio by opening the purge control valve 17 for the period of the product of the duty ratio and 1 ms.

In following step 84, the duty ratio DX for the current duty cycle is substituted for the renewed duty ratio DI. This renewed duty ratio DI is calculated on the basis of the engine operating condition when the first counter value equals to 24, namely at the time of 4 ms before the current duty cycle starts. Therefore, the response delay of the duty control is reduced. Then, the routine goes to step 85, the calculation flag is set, and in following step 86, the first counter value T1 is cleared. Then, the processing cycle is ended. Accordingly, it can be understood that the portion from step 81 to step 86 is executed every 100 ms.

If T1=24 in step 76, the routine goes to step 77, where the second counter value T2 is cleared. Then, the routine goes to steps 78 and 79, and the processing cycle is ended. Accordingly, it can be understood that the routine goes to the portion from step 77 to step 79 when 96 ms has passed since each duty cycle starts, except when the first counter value T1 is set 24 in step 74 and thereby the routine goes to steps 78 and 79.

Figure 10:
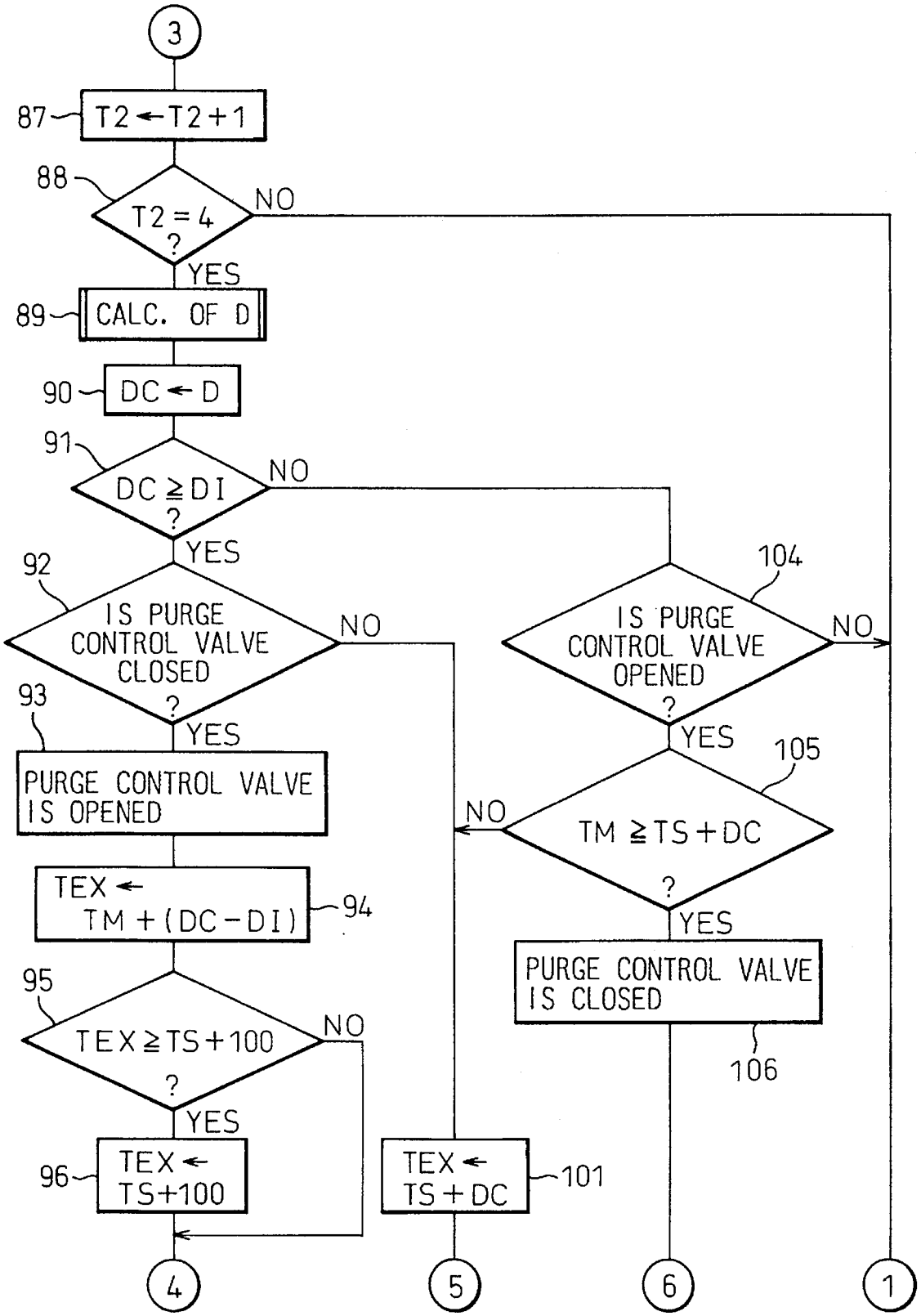

Contrarily, in step 80, if T1≠25, namely if the first counter value T1 is from 1 to 23, the routine goes to step 87 shown in FIG. 10. In step 87, the second counter value T2 is incremented by 1. In following step 88, it is determined whether the second counter value T2 equals to 4. If T2≠4, namely, if the second counter value T2 is within 1 to 3, the processing cycle is ended. If T2=4, the routine goes to step 89, where the duty ratio is calculated using the routine shown in FIG. 12 on the basis of the current engine operating condition. In following step 90, the duty ratio calculated in step 89 is substituted for the corrected duty ratio DC.

In following step 91, it is determined whether the corrected duty ratio DC is larger than the current duty ratio DI. If DC≧DI, the routine goes to step 92, where it is determined whether the purge control valve 17 is already closed. If it is determined that the purge control valve 17 is already closed, the routine goes to step 93, where the purge control valve 17 is opened again. In following step 94, TEX, representing the closing time of the purge control valve 17, is calculated using the following equation:

$$TEX=TM+(DC-DI)$$

Namely, TEX is obtained by adding the increment of the duty ratio (DC−DI) to the current time TM. Next, the routine goes to step 95, where it is determined whether TEX is larger than TS+100. If TEX≧100, the closing time is later than the end time of the current duty cycle, and thus, the routine goes to step 96, where TEX is made equal to TS+100. Then, the routine goes to step 97 shown in FIG. 11. If TEX<100, in step 95, the routine jumps to step 97.

In step 97, the closing time TE is changed to TEX, and TEX is set in the timer. In following step 98, the duty ratio DI is calculated using the following equation:

$$DI=DI+(TE-TM)$$

Namely, the duty ratio DI is obtained by adding the increment of the duty ratio to the current duty ratio. Then, the routine goes to step 99.

Figure 11:
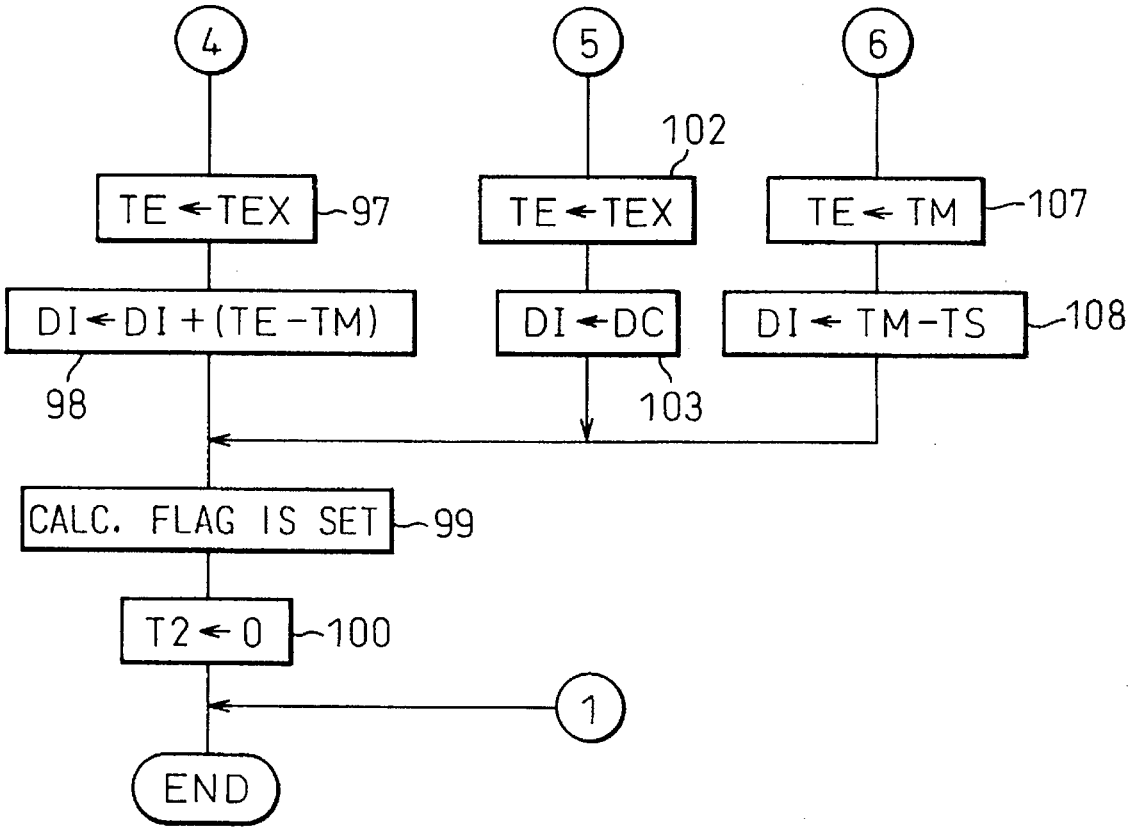

However, in step 92, if it is determined that the purge control valve 17 is still opened, the routine goes to step 101, where TEX is calculated by adding the corrected duty ratio DC to the start time of the current duty cycle TS. Then, the routine goes to step 102 as shown in FIG. 11, where the closing time TE is changed to TEX and is set in the timer. In following step 103, the corrected duty ratio DC is substituted for the duty ratio DI. Then, the routine goes to step 99.

On the other hand, in step 91, if DC<DI, the routine goes to step 104, where it is determined whether the purge control valve 17 is still opened. If it is determined that the purge control valve 17 is already closed, the processing cycle is ended. If it is determined that the purge control valve 17 is still opened, the routine goes to step 105, where it is determined whether the current time TM is after the time TS+DC, which is the closing time when assuming that the duty ratio is DC obtained in step 90. If TM≧TS+DC, the routine goes to step 106, where the purge control valve 17 is closed. Then, the routine goes to step 107 shown in FIG. 11. If TM<TS+DC, in step 105, the routine goes to step 99, via steps 101, 102, and 103.

In step 97, the closing time TE is changed to the current time TM, and is set in the timer. Therefore, the purge control valve 17 is closed at this time. In following step 108, the duty ratio DI is calculated by subtracting the start time of the duty cycle TS from the current time TM. Then, the routine goes to step 99.

In step 99, the calculation flag is set. In following step 100, the second counter value T2 is cleared. Therefore, the routine goes to the portion from step 89 to step 108 every 16 ms after the respective duty cycle starts. Then, the processing cycle is ended.

Figure 12:
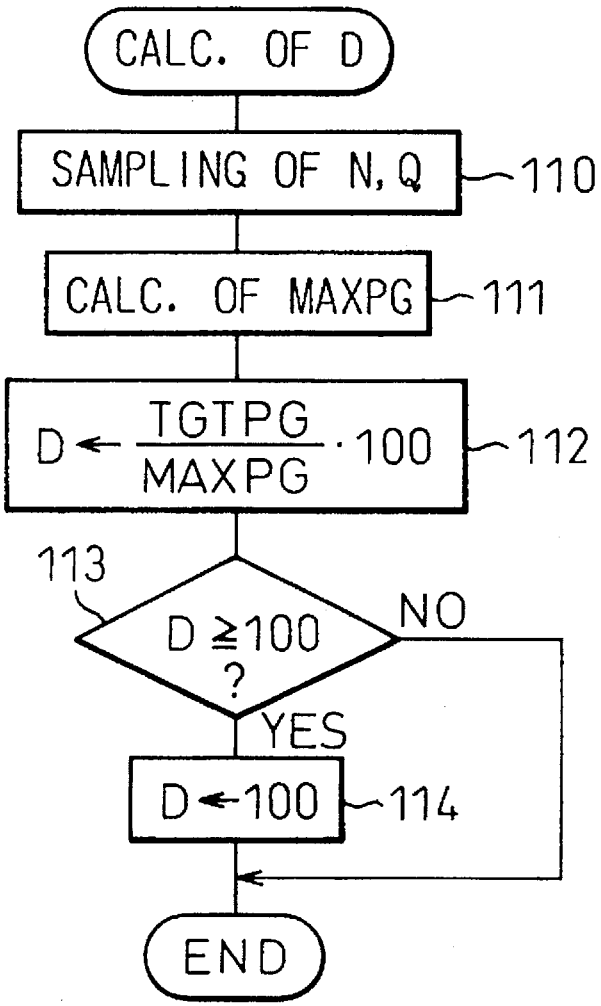
FIG. 12 is a flowchart for calculating a duty cycle.

FIG. 12 illustrates a routine for calculating the duty ratio D. This routine corresponds to step 78 shown in FIG. 8 and to step 89 shown in FIG. 10.

Referring to FIG. 12, first, in step 110, sampling of the current engine speed N and the current engine load Q/N is carried out. In following step 111, the maximum purge ratio MAXPG is calculated using the map shown in FIG. 3C on the basis of the N and Q/N obtained in step 110. In following step 112, the duty ratio D is calculated using the following equation:

$$D=(TGTPG/MAXPG)\cdot 100$$

Then, the routine goes to step 113, where it is determined whether the duty ratio D is larger than 100%. If D<100%, the processing cycle is ended. If D≧100%, the routine goes to step 114, where the duty ratio D is made 100%. Then, the processing cycle is ended.

Figure 13:
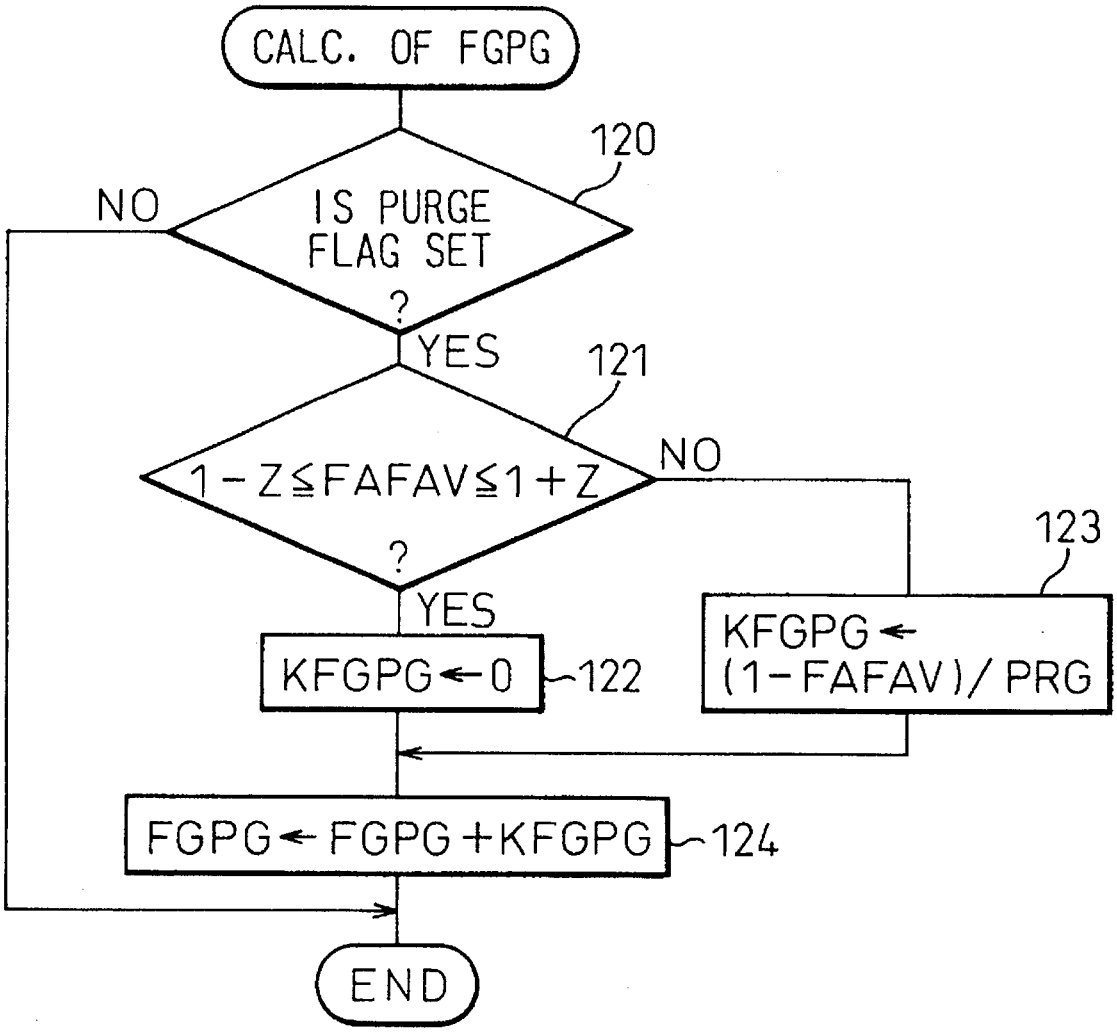
FIG. 13 is a flowchart for calculating a fuel vapor concentration coefficient.

FIG. 13 illustrates a routine for calculating the fuel vapor concentration coefficient FGPG. This routine is executed in, for example, the main routine.

Referring to FIG. 13, first, in step 120, it is determined whether the purge flag, which is set in step 73 shown in FIG. 8, is set. If the purge flag is reset, the processing cycle is ended. If the purge flag is set, the routine goes to step 121, where the average of the feedback correction coefficient FAFAV is within the predetermined range, namely whether 1−Z≦FAFAV≦1+Z. If 1−Z≦FAFAV≦1+Z, the routine goes to step 122, where the renewing value KFGPG of FGPG is made zero. Then, the routine goes to step 124. If FAFAV<1−Z or 1+Z< FAFAV, the routine goes to step 123, where the renewing value KFGPG is calculated using the following equation:

$$KFGPG=(1-FAFAV)/PRG$$

Namely, the renewing value KFGPG is made the deviation of the average of the feedback correction coefficient per the unit purge ratio. Then, the routine goes to step 124.

In step 124, the fuel vapor concentration coefficient FGPG is calculated using the following equation:

$$FGPG=FGPG+KFGPG$$

Then, the processing cycle is ended.

Figure 14:
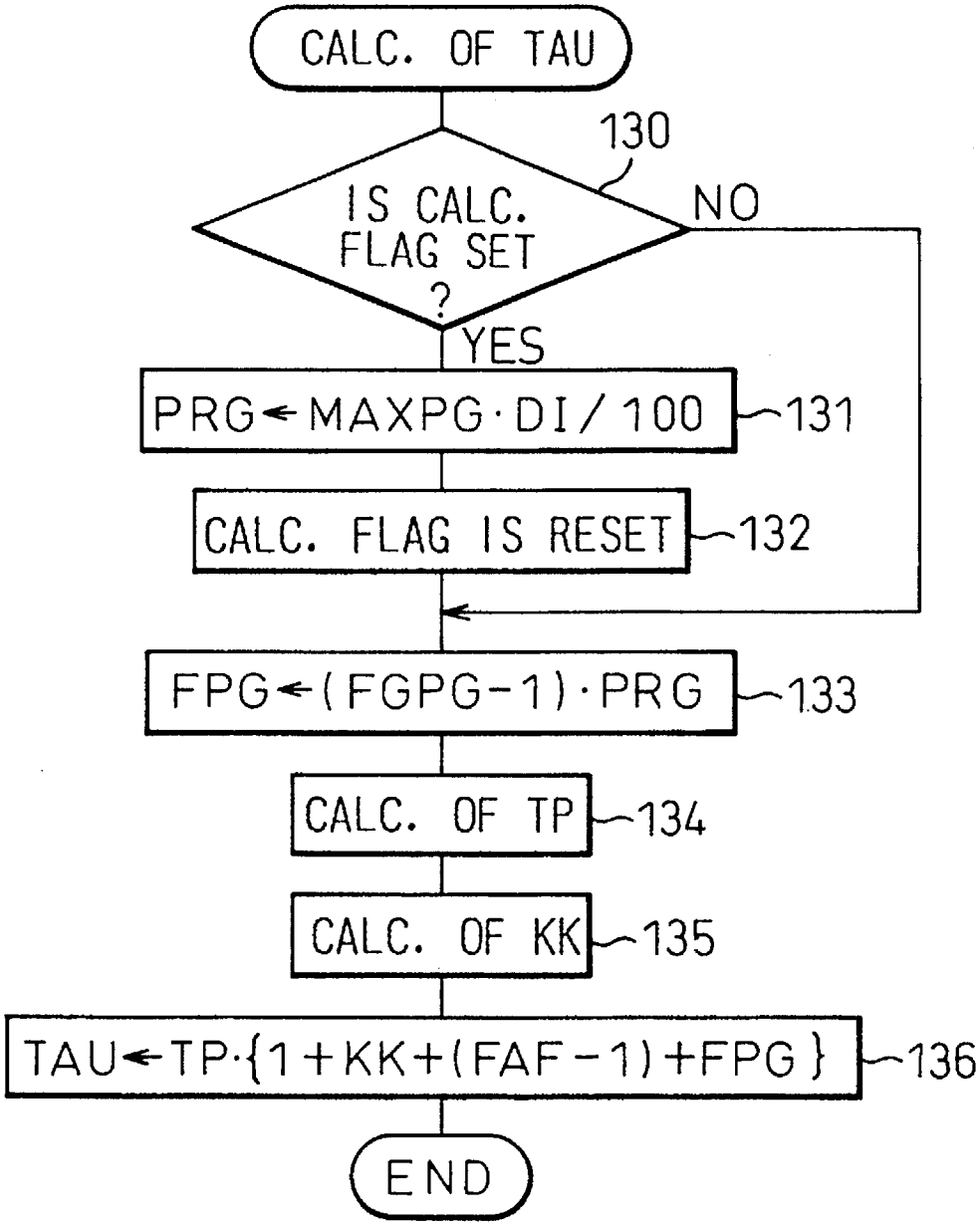
FIG. 14 is a flowchart for calculating a fuel injection time.

FIG. 14 illustrates a routine for calculating the fuel injection time TAU. This routine is executed by interruption every predetermined crank angle.

Referring to FIG. 14, first, in step 130, it is determined whether the calculation flag is set. If the calculation flag is reset, the routine jumps to step 133. If the calculation flag is set, the routine goes to step 131, where the purge ratio PRG is calculated using the following equation:

$$PRG=MAXPG\cdot DI/100$$

In the calculation of the duty ratio D executed in step 112 shown in FIG. 12, when the maximum purge ratio MAXPG becomes small and thereby (TGTPG/MAXPG)·100 becomes over 100, the duty ratio D is fixed to 100. Therefore, if (TGTPG/MAXPG)·100 becomes over 100, the purge ratio PRG is smaller than the target purge ratio TGTPG. Accordingly, if the purge control valve 17 is substantially fully opened, the purge ratio PRG becomes smaller when the maximum purge ratio MAXPG becomes smaller. In this connection, the purge ratio PRG equals to the target purge ratio TGTPG, as long as (TGTPG/MAXPG)·100 is smaller than 100. Then, the routine goes from step 131 to step 132, where the calculation flag is reset. Then, the routine goes to step 133.

In step 133, the purge correction coefficient FPG is calculated using the following equation:

$$FPG=(FGPG-1)\cdot PRG$$

In following steps 134 and 135, the basic fuel injection time TP and the enrichment coefficient KK are calculated. Then, the routine goes to step 136, where the fuel injection time TAU is calculated using the following equation:

$$TAU=TP\cdot\{1+KK+(FAF-1)+FPG\}$$

The fuel injector 4 injects fuel for this injection time TAU.

According to the present invention, it is possible to maintain the amount of the purge gas at the target amount thereof.

While the invention has been described by reference to specific embodiments chosen for purposes of illustration, it should be apparent that numerous modifications could be made thereto by those skilled in the art without departing from the basic concept and scope of the invention.

We claim:

1. A fuel supply control system for an engine having an intake passage and a throttle valve arranged in the intake passage, the system comprising:

a canister for temporarily storing fuel vapor, the canister being connected to the intake passage downstream of the throttle valve through a purge passage;

a purge control valve arranged in the purge passage for controlling an amount of a purge gas fed into the engine through the purge passage, the purge control valve being cyclically opened and closed, and being adapted to be duty controlled to make an opening ratio of the purge control valve equal to a duty ratio in each duty cycle;

first duty ratio calculating means for calculating a duty ratio for every duty cycle of the duty control of the purge control valve, required to make the amount of the purge gas equal to a target amount of the purge gas determined in accordance with the engine operating condition, first duty ratio calculating means calculating the duty ratio before the corresponding duty cycle starts in accordance with an engine operating condition at that time;

driving means for driving the purge control valve to make the opening ratio of the purge control valve equal to the duty ratio calculated by the first duty ratio calculating means in each duty cycle;

second duty ratio calculating means for calculating a duty ratio for the duty control of the purge control valve, required to make the amount of the purge gas equal to the target amount of the purge gas, second duty ratio calculating means calculating the duty ratio when the corresponding duty cycle is in process in accordance with an engine operating condition at that time; and control means for controlling driving means so that driving means drives the purge control valve to make the opening ratio of the purge control valve equal to the duty ratio calculated by the second duty ratio calculating means during the corresponding duty cycle.

2. A system according to claim 1, wherein the duty ratio is determined as a ratio of a target purge ratio to a reference purge ratio, the purge ratio being defined as a ratio of the amount of the purge gas fed into the engine to that of air fed into the engine.

3. A system according to claim 2, wherein the reference purge ratio is a maximum purge ratio which is obtained when the purge control valve is substantially fully opened.

4. A system according to claim 2, wherein the target purge ratio is substantially constant.

5. A system according to claim 4, wherein the target purge ratio is approximately 5%.

6. A system according to claim 1, wherein the second duty ratio calculating means calculates the duty ratio two or more times in each duty cycle.

7. A system according to claim 1, wherein the control means controls the driving means to again open the purge control valve for a period corresponding to an increment of the duty ratio, when the duty ratio calculated by the second duty ratio calculating means is larger than the current duty ratio, while the purge control valve is closed when the purge control valve is to be driven in accordance with the duty ratio calculated by the second duty ratio calculating means.

8. A system according to claim 1, wherein the control means controls the driving means to close the purge control valve immediately, when the duty ratio calculated by the second duty ratio calculating means is smaller than the current duty ratio, while the purge control valve is opened when the purge control valve is to be driven in accordance with the duty ratio calculated by the second duty ratio calculating means.

9. A system according to claim 1, wherein the first duty ratio calculating means calculates the duty ratio just before the corresponding duty cycle starts.

10. A system according to claim 1, wherein the canister comprises: an activated charcoal layer housed therein; a fuel vapor chamber formed on one side of the activated charcoal layer; and an air chamber formed on another side of the activated charcoal layer, and wherein the fuel vapor chamber is connected to the intake passage downstream of the throttle valve via the purge passage and to a fuel vapor source, and the air chamber is connected to the outside air, whereby air passes through, in turn, the air chamber, the activated charcoal layer, the fuel vapor chamber, and the intake passage to thereby form the purge gas, during the purging operation.

11. A system according to claim 10, the engine further having a fuel tank, wherein the fuel vapor source comprises the fuel tank.

12. A system according to claim 1, wherein a duty cycle time is set at approximately 100 ms.

13. A system according to claim 1, further comprising: a fuel injector for feeding pressurized fuel into the engine; fuel amount calculating means for calculating an amount of fuel to be injected from the fuel injector, required to make an air-fuel ratio equal to a target air-fuel ratio; means for obtaining an amount of fuel vapor or a concentration of fuel vapor in air fed into the engine; and reducing means for reducing the amount of fuel calculated by the fuel amount calculating means, in accordance with the amount of fuel vapor or the concentration of fuel vapor, to make an air-fuel ratio equal to a target air-fuel ratio, during the purging operation.

14. A system according to claim 13, the engine further having an exhaust passage, the system further comprising an air-fuel ratio sensor arranged in the exhaust passage for sensing an air-fuel ratio, and feedback control means for feedback controlling the amount of fuel to be injected using a feedback correction coefficient in accordance with the air-fuel ratio detected by the air-fuel ratio sensor to make the air-fuel ratio equal to the target air-fuel ratio.

15. A system according to claim 14, wherein the obtaining means obtains the amount or the concentration of fuel vapor in accordance with the feedback correction coefficient.

16. A system according to claim 13, wherein the target air-fuel ratio is a stoichiometric air-fuel ratio.

* * * * *